US010974516B2

(12) United States Patent
Moriya

(10) Patent No.: US 10,974,516 B2
(45) Date of Patent: Apr. 13, 2021

(54) DEVICE, METHOD FOR CONTROLLING DEVICE, AND STORAGE MEDIUM

(71) Applicant: CANON KABUSHIKI KAISHA, Tokyo (JP)

(72) Inventor: Akihiro Moriya, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/926,457

(22) Filed: Mar. 20, 2018

(65) Prior Publication Data

US 2018/0272733 A1 Sep. 27, 2018

(30) Foreign Application Priority Data

Mar. 24, 2017 (JP) ..... JP2017-058586

(51) Int. Cl.
*B41J 2/175* (2006.01)
*G03G 15/00* (2006.01)

(52) U.S. Cl.
CPC ..... *B41J 2/17566* (2013.01); *B41J 2/17533* (2013.01); *B41J 2/17546* (2013.01); *G03G 15/502* (2013.01); *G03G 15/5079* (2013.01); *G03G 15/553* (2013.01); *G03G 15/556* (2013.01)

(58) Field of Classification Search
CPC ..... H04N 2201/0094; H04N 1/4433; H04N 1/00474; H04N 1/4413; H04N 1/4406; H04N 1/00408; H04N 1/444; G06F 3/1204; G06F 21/31; G06F 3/1238; G06F 3/1222; G06F 21/10; B41J 2/17546; B41J 2/17566; B41J 2/17533; B41J 29/38; G03G 15/502; G03G 15/5091; G03G 15/5079; G03G 15/556; G03G 15/553
See application file for complete search history.

(56) References Cited

U.S. PATENT DOCUMENTS

2003/0084288 A1* 5/2003 de Jong ..... G06F 21/33 713/168
2005/0200636 A1* 9/2005 Silverbrook ..... G06F 3/03545 347/2
2006/0283933 A1* 12/2006 Ueda ..... H04N 1/2346 235/375
2017/0013170 A1* 1/2017 Sato ..... H04N 1/4433
(Continued)

FOREIGN PATENT DOCUMENTS

JP 2010-61694 A 3/2010
JP 2010055357 A 3/2010
JP 2015176476 A 10/2015
(Continued)

OTHER PUBLICATIONS

Charles R. Dyer, Volumetric Scene Reconstruction from Multiple Views, Foundations of Image Understanding, L. S. Davis, ed., 2001, pp. 469-488, Kluwer, Boston, XP2325058.
(Continued)

*Primary Examiner* — Jannelle M Lebron
(74) *Attorney, Agent, or Firm* — Canon U.S.A., Inc. IP Division

(57) ABSTRACT

An apparatus specifies authority of a user who is logged onto the apparatus. The apparatus enables displaying a first display item for purchasing a consumable based on at least the presence or absence of the specified authority of logged in user.

13 Claims, 7 Drawing Sheets

(56) References Cited

U.S. PATENT DOCUMENTS

2018/0098047 A1 4/2018 Itakura et al.

FOREIGN PATENT DOCUMENTS

| | | | | |
|---|---|---|---|---|
| JP | 2017049748 | A | | 3/2017 |
| JP | 2017073057 | A | * | 4/2017 |
| WO | 2018/222033 | A1 | | 6/2018 |

OTHER PUBLICATIONS

Maarten Slembrouck, et al. Cell-Based Approach for 3D Reconstruction from Incomplete Silhouettes, ACIVS, 2017, pp. 530-541, Springer International Publishing, XP47455579.

Tatsuhisa Yamaguchi, et al., Cell-based Object Tracking Method for 3D Shape Reconstruction Using Multi-viewpoint Active Cameras, 2009 IEEE 12th International Conference on Computer Vision Workshops, ICCV Workshops, pp. 1306-1313, XP316644090.

* cited by examiner

300

| 301 USER ID | 302 PASSWORD | 303 E-MAIL ADDRESS | 304 ROLE |
|---|---|---|---|
| Admin | ********* | admin@example.com | Administrator |
| UserA | ********* | usera@example.com | GeneralUser |
| UserB | ********* | userb@example.com | GeneralUser |
| UserC | ********* | userc@example.com | GeneralUser |
| UserD | ********* | userd@example.com | GeneralUser |
| ⋮ | ⋮ | ⋮ | ⋮ |

DEVICE, METHOD FOR CONTROLLING DEVICE, AND STORAGE MEDIUM

BACKGROUND

Field

The present disclosure relates to a device that changes a process concerning a consumable based on user authority in a device in which a process involving the consumable is performed.

Description of the Related Art

During operation of a printer or a multifunction peripheral, consumables, such as toner, photosensitive drum units, recording sheets, ADF roller units, etc., to be used for printing and reading of an image are needed. In the related art technology, when it is detected that a consumable is to be supplied, information on purchase of the consumable is printed out to save time and reduce the burden on a user for the purchase of the consumable. In another related art technology, automatic dialing to a predetermined order destination is performed when a remaining amount of a consumable becomes insufficient. Japanese Patent Laid-Open No. 2010-61694 discloses a technology to display a delivery purchase button on a status screen depending on a consumed degree of a consumable.

SUMMARY

An apparatus configured to execute a process involving a consumable includes at least one memory device that stores a set of instructions, and at least one processor that executes the instructions, the instructions, when executed, causing the apparatus to perform operations including specifying authority of a user who is logged onto the apparatus, and controlling to display a first display item for purchasing a consumable based on at least a presence or absence of the specified authority of the logged in user.

Further features will become apparent from the following description of exemplary embodiments with reference to the attached drawings.

DESCRIPTION OF THE EMBODIMENTS

In operation system of the present embodiment, an administrator and a general user or an administrator group and a general group exist, and the administrator or the administrator group collectively manages purchase of consumables. The present embodiment provides a mechanism for performing an appropriate process related to the purchase of consumables based on user authority so that orders that are not intentionally made by an administrator will not be made when a general user or a general group that does not have purchase authority for consumables presses a delivery purchase button. Hereinafter, embodiments of the present disclosure will be described with reference to the drawings.

Figure 1:
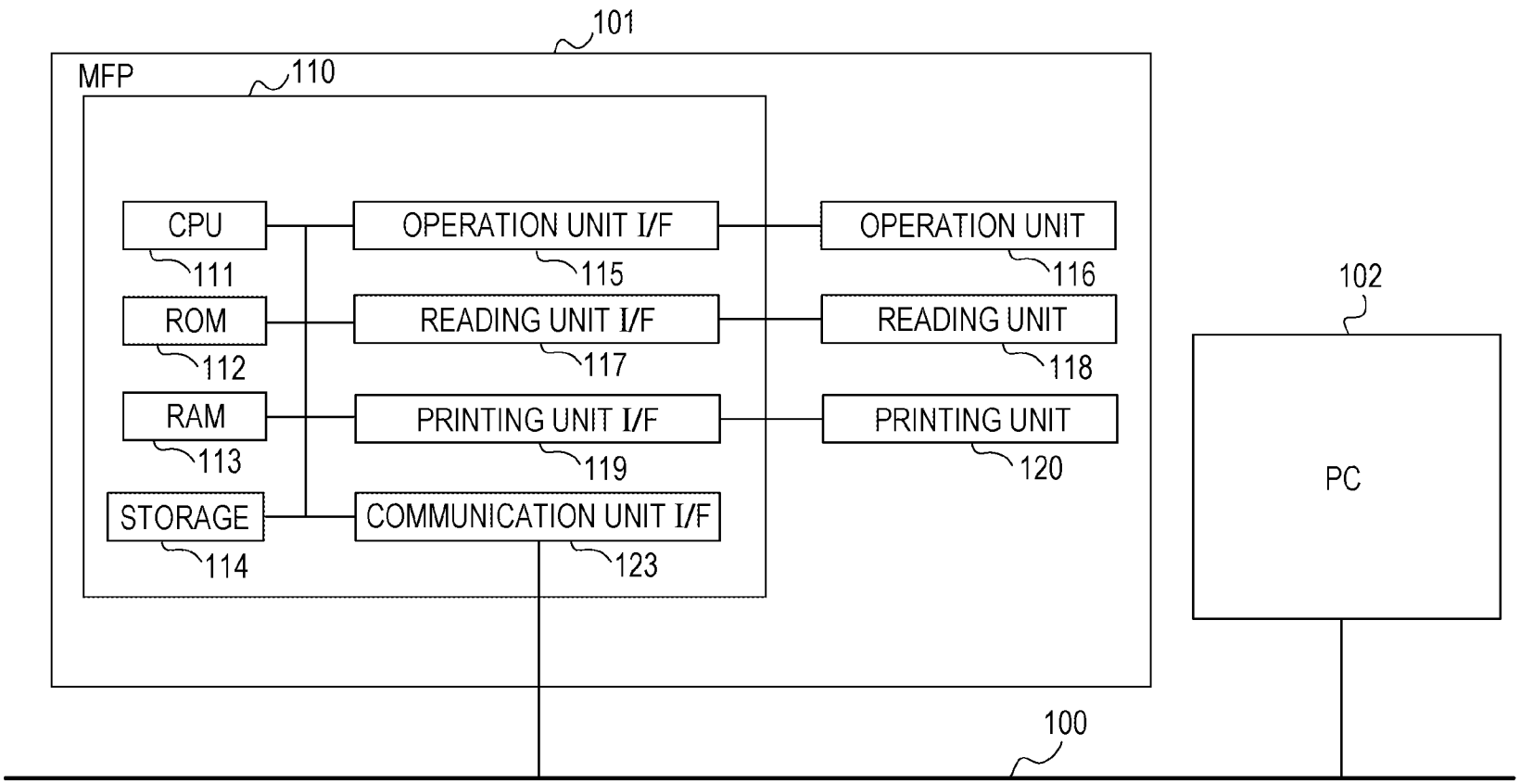
FIG. 1 illustrates an entire image processing system.

FIG. 1 illustrates an entire image processing system according to the present embodiment. The image processing system includes a multifunction peripheral (MFP) 101 and a personal computer (PC) 102. The MFP 101 and the PC 102 are connected to and communicate with each other via a network 100. The MFP 101 is an example of an information processing apparatus. Although a single PC 102 is illustrated in FIG. 1, a plurality of PCs 102 can be connected to the MFP 101 to communicate with the MFP 101 via the network 100.

The PC 102 can execute various types of programs, such as an application program. A printer driver for transmitting print data to a printer, such as the MFP 101, is installed on the PC 102. A user who wants to print can issue a print instruction from various types of applications. The printer driver can transform data output from the applications based on the print instruction into a PDL format interpretable by the MFP 101 and can transmit to the MFP 101.

The MFP 101 includes a reading function to read an image on a sheet, and a print function to print an image on a sheet. The MFP 101 also includes a file transmission function to transmit image data to an external device, and so forth. Although the present embodiment will be described with reference to the MFP 101 as an example of an information processing apparatus, the present embodiment is not limited hereto. For example, the information processing apparatus can be a printing apparatus, such as a printer, without a reading function. The information processing apparatus can also be a three-dimensional printer, which forms a three-dimensional object, etc. The present embodiment is applicable to an information processing apparatus that includes a replaceable or suppliable consumable material or consumable part.

As illustrated in FIG. 1, the control unit 110, which includes a central processing unit (CPU) 111, controls operation of the entire MFP 101. The CPU 111 reads a control program stored in read-only memory (ROM) 112 or storage 114 and performs various types of control, such as reading control and print control. The ROM 112 stores control programs executable by the CPU 111. Random access memory (RAM) 113 is main memory of the CPU 111 and is used as a work area or as a temporary storage area for loading various control programs stored in the ROM 112 and the storage 114. The storage 114 stores print data, image data, various programs, and various types of setting information. In the present embodiment, an auxiliary storage device, such as a hard disk drive (HDD), can be used as the storage 114. Nonvolatile memory, such as a solid-state drive (SSD), can be used instead of the HDD.

Functions and processes of the MFP 101 described below are implemented when the CPU 111 reads a program stored in the ROM 112 and the storage 114 and executes the read program. Although a single CPU 111 performs each process illustrated in below-described flowcharts using an individual memory (RAM 113) in the MFP 101 of the present embodiment, other embodiments can be similarly employed. For example, each process illustrated in the below-described flowcharts can be executed by making a plurality of CPUs, RAM, ROM, and storage operate in accordance with each other. Some of the processes can be executed using a hardware circuit, such as an application specific integrated circuit (ASIC) or a field-programmable gate array (FPGA).

Figures 2, 3:
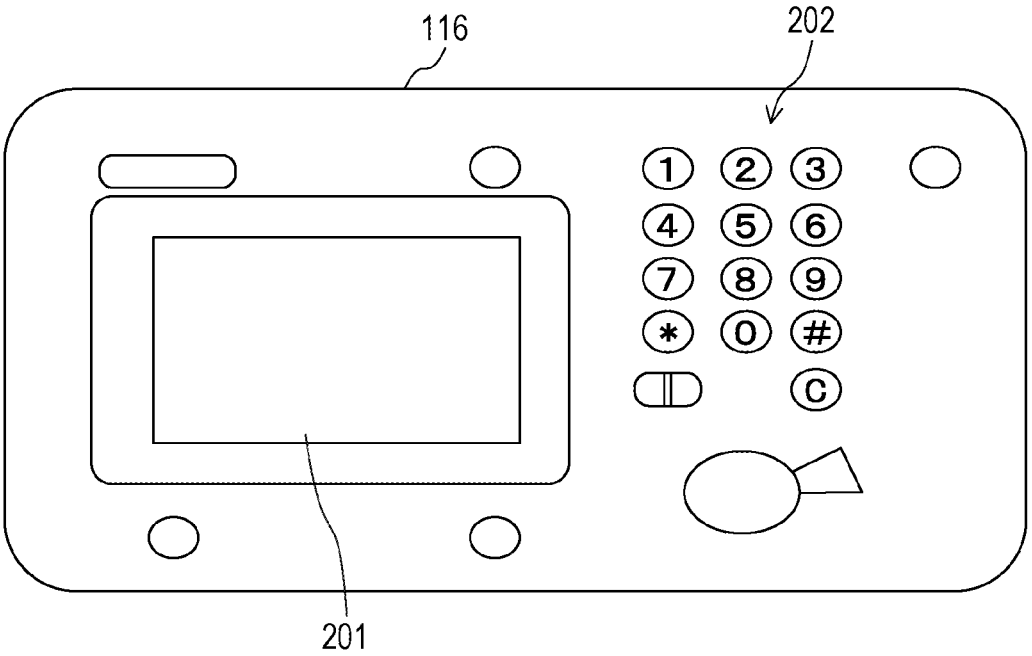
FIG. 2 is an external view of an operation unit.
FIG. 3 illustrates an example of user information.

An operation unit interface (I/F) 115 connects the operation unit 116 and the control unit 110 to each other. FIG. 2 is an external view of the operation unit 116. The operation unit 116 consists of a below-described panel 201, which displays a screen, and a physical key input unit 202. The panel 201 is, for example, a touch panel display. The physical key input unit 202 includes various physical keys, such as a numeric keypad, with which numeric values are input. The user inputs an instruction by touching keys displayed on the panel 201 or pressing various physical keys of the physical key input unit 202. The operation unit 116 functions as a display unit that in turn functions as a receiving unit for receiving instructions from the user through the panel 201 and the physical key input unit 202, and the operation unit 116 displays an operation screen on the panel 201 as needed.

Returning to the description of FIG. 1, the reading unit I/F 117 connects the reading unit 118 and the control unit 110 to each other. The reading unit 118 reads an image on the document and generates image data. The image data generated by the reading unit 118 is transmitted to an external device or printed on a sheet. The reading unit 118 can read the sheet placed on a document feeder (not illustrated) at high speed to read a plurality of documents.

A print unit I/F 119 connects a print unit 120 and the control unit 110 to each other. Image data to be printed is transferred from the control unit 110 to the print unit 120 via the print unit I/F 119. The print unit 120 receives a control command and image data to be printed via the control unit 110 and prints an image on the sheet based on the image data. A printing system of the print unit 120 can be an electrophotographic system or an inkjet system. In the electrophotographic system, an electrostatic latent image is formed on a photosensitive member, the electrostatic latent image is developed with toner, a toner image is transferred to the sheet, and the transferred toner image is fixed. In this manner, an image is formed. In the inkjet system, ink is ejected to form an image on the sheet.

Consumables used for printing, such as a toner cartridge and an ink cartridge, by the print unit 120 are removably attached internally to the MFP 101. The user can resupply the consumables by replacing the cartridges. The CPU 111 acquires a remaining amount of a consumable material necessary for printing at a periodic timing, at a timing of printing one page of an image, or at a timing at which the cartridge is attached, and stores the acquired remaining amount of the consumable material in the RAM 113. The CPU 111 stores a part number of the cartridge in the RAM 113 or the storage 114 when attaching the cartridge. Although the CPU 111 determines the part number of the cartridge based on the physical shape (for example, the shape of a notch) of the cartridge, storage and determination of the part number are not limited to such a case. For example, the cartridge can include non-transitory memory and can contain a part number or other information in the memory. In this case, the CPU 111 acquires the part number of the cartridge attached to the MFP 101 by reading the non-transitory memory provided in the attached cartridge.

The control unit 110 is connected to the network 100 via a communication unit I/F 123. The communication unit I/F 123 transmits an e-mail message to an external device on the network 100 or receives print data and information from the information processing apparatus on the network 100. The print data received via the communication unit I/F 123 is analyzed by a software module (a PDL analyzer, not illustrated) for analyzing print data stored in the storage 114 or the ROM 112. The PDL analyzer generates data to be printed by the print unit 120 in based on print data expressed in various page-description language (Page Description Language) formats.

FIG. 3 illustrates an example of user information stored in the storage 114 of the MFP 101. The user information 300 is information for managing a user logging onto the MFP 101 and includes a user ID 301, a password 302, an e-mail address 303, and a role 304. The user information 300 can further include other management data, such as an expiration date of the password 302.

The user ID 301 is a user ID for uniquely identifying a user. The password 302 is a password for authenticating a user. The e-mail address 303 is an e-mail address corresponding to the user. The role 304 is information indicating user authority. Here, the role 304 indicates two types of authorities: "Administrator" indicating authority to manage the MFP 101 (management authority) and "GeneralUser" indicating general authority of the MFP 101 (general authority). Here, general authority has a more limited range of authority than the management authority. For example, a user with a role 304 of "Administrator" can perform a management setting of the MFP 101, etc. Hereinafter, a user having a role 304 of "Administrator" will be referred to as an administrator. A user with a role 304 of "GeneralUser" can selectively use functions provided by the MFP 101, such as a copy function and a transmission function of a scanned image.

Although a case in which the role 304 is "Administrator" or "GeneralUser" is described here, the role is not limited to a role of an administrator or a general user. For example, a customized role to which authority of the administrator is partially transferred can also be created. For example, the administrator can create the customized role "Supplier" to which management authority regarding the consumable has been added to the authority for the general user. The administrator can assign the role 304 "Supplier" to a user in charge of an accounting department, etc., such that management authority related to the consumable can be provided to the user of the accounting department.

Figure 4:
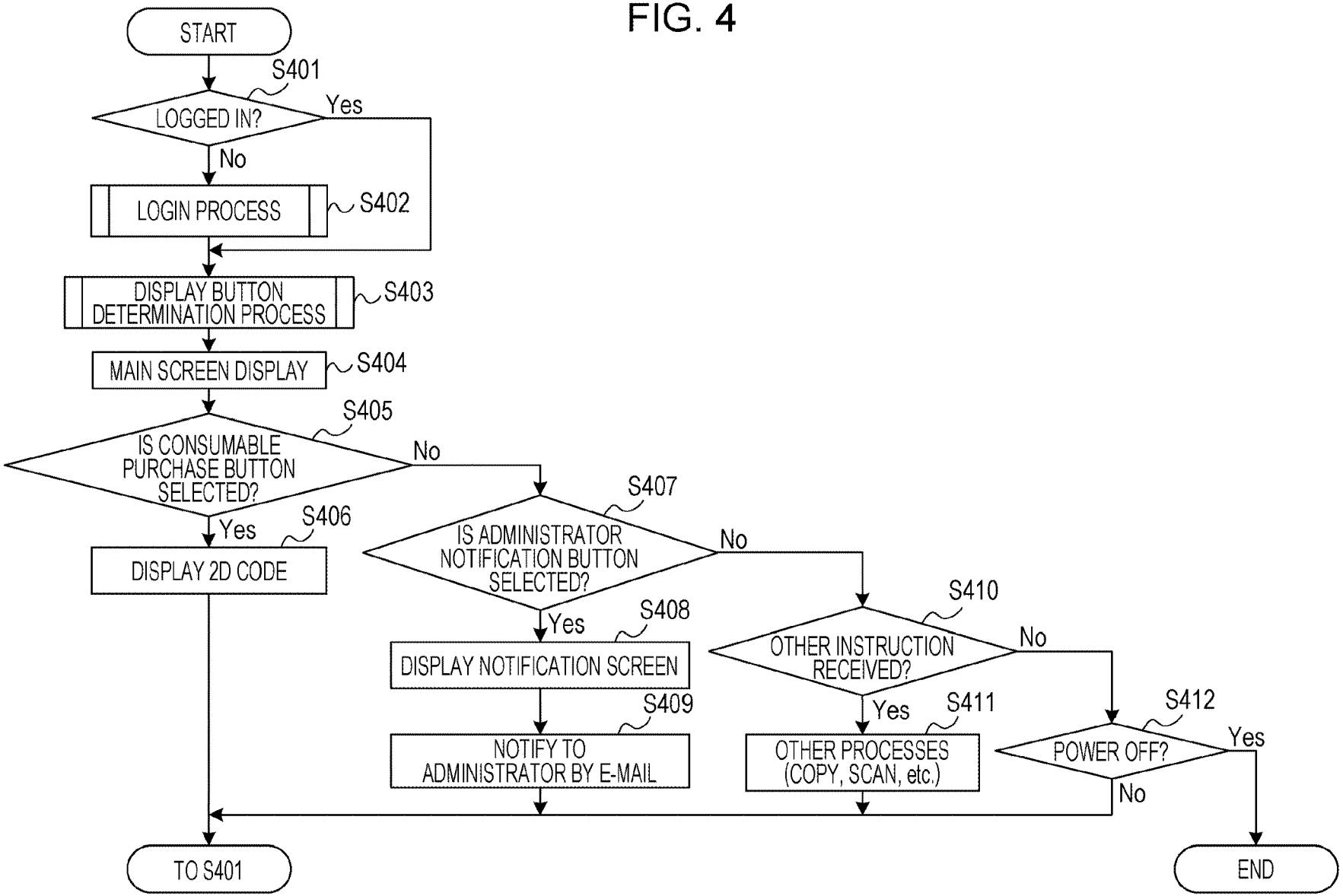
FIG. 4 is a flowchart illustrating a consumable management process.

FIG. 4 is a flowchart illustrating a consumable management process performed by the MFP 101. The CPU 111 of the MFP 101 starts a consumable management process when the MFP 101 is powered on. In S401, the CPU 111 checks a logon state of the user. If there is no user logged onto the MFP 101 (S401: No), the CPU 111 proceeds to S402 in the process. If there is a user who is logged on (S401: Yes), the CPU 111 proceeds to S403. In S402, the CPU 111 performs a logon process.

Figure 5:
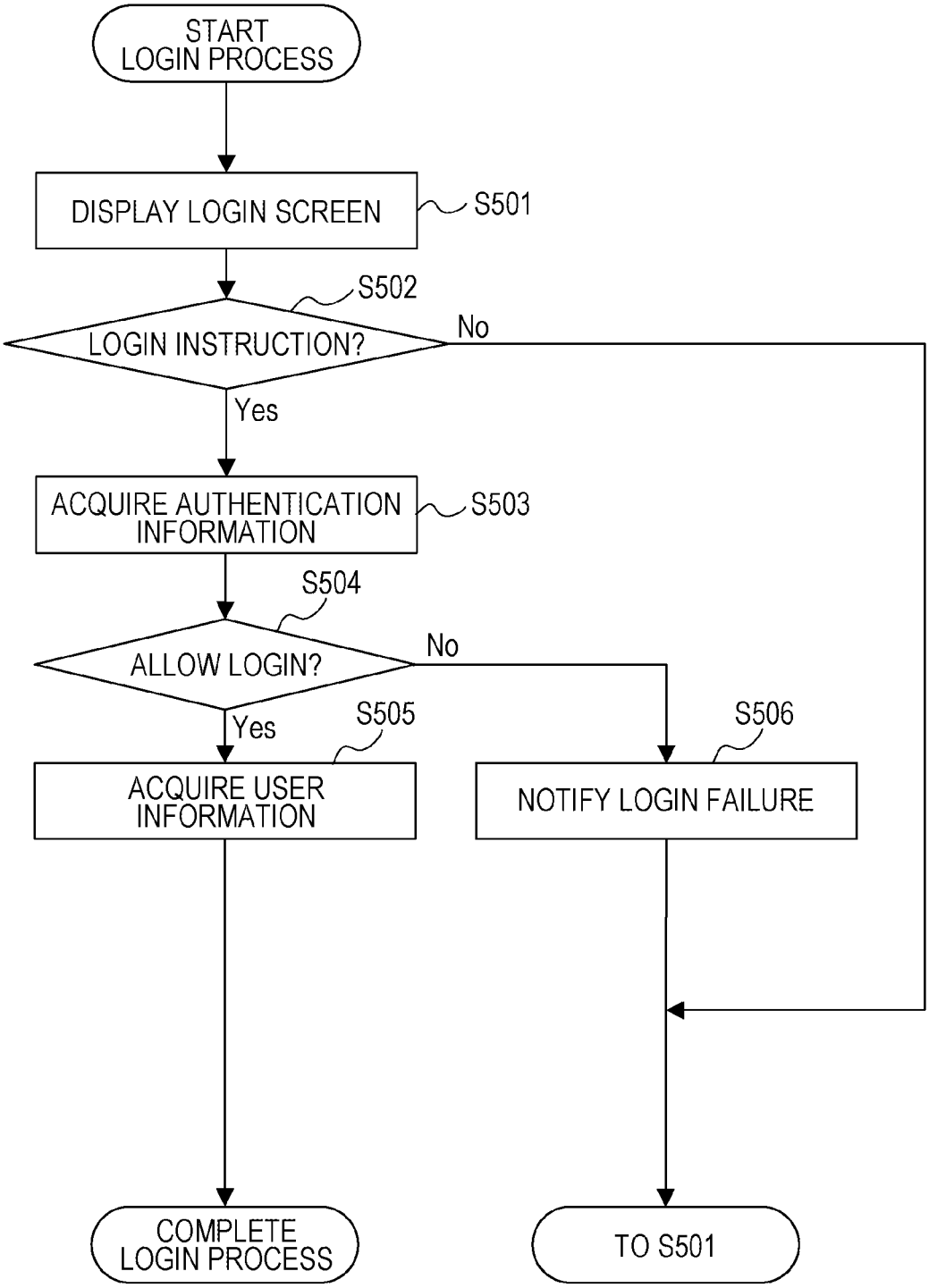
FIG. 5 is a flowchart illustrating a logon process.

FIG. 5 is a flowchart illustrating a logon process performed by the MFP 101. In S501, the CPU 111 displays a logon screen on the panel 201. The CPU 111 receives user input via the operation unit 116 (e.g., input of authentication information via the logon screen).

Figure 6:
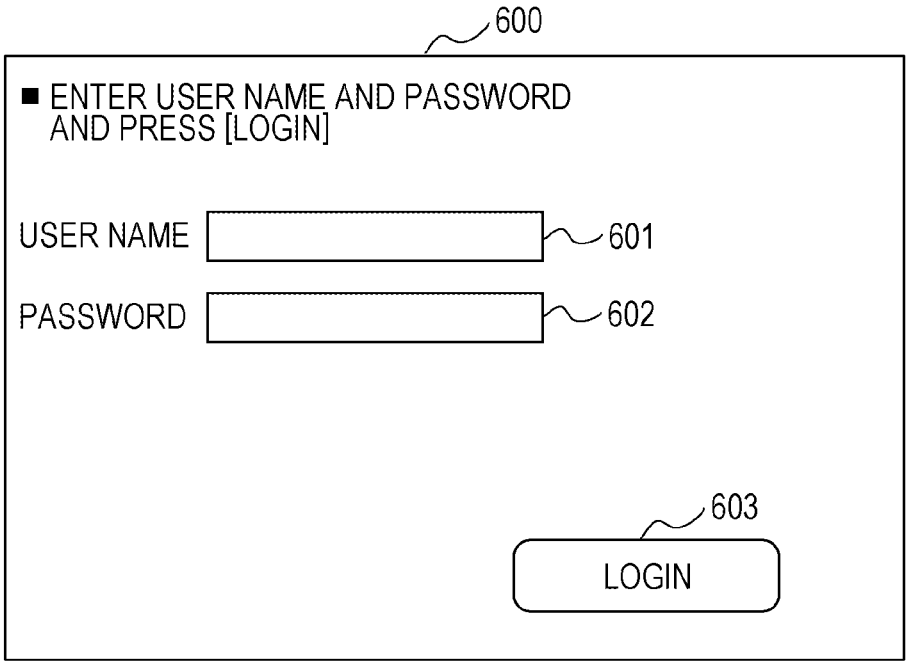
FIG. 6 illustrates an example of a logon screen.

FIG. 6 illustrates an example of the logon screen. The user can log onto the MFP 101 by inputting the user's user ID and password via the logon screen 600. The user can input a user ID in a region 601 and input a password in a region 602. A logon key 603 is an operation key for starting the logon process. When the logon key 603 is pressed, the CPU 111 collates authentication information input into the regions 601 and 602 and authentication information stored in the user information and determines whether to allow the user to log on.

Returning to FIG. 5, after the process of S501, the CPU 111 determines whether a logon instruction has been issued in S502. In particular, when the authentication information (user ID and password) is input via the logon screen 600 and the logon key 603 is pressed, the CPU 111 determines that a logon instruction has been issued. If the logon key 603 is not pressed, the CPU 111 determines that no logon instruction has been issued. If the CPU 111 determines that the logon instruction has issued (S502: Yes), the CPU 111 proceeds to S503. If the CPU 111 determines that the logon instruction has not issued (S502: No), the CPU 111 proceeds to S501.

In S503, the CPU 111 acquires the authentication information (user ID and password) input via the logon screen 600. Next, in S504, the CPU 111 collates the authentication information acquired in S503 and the user information. The CPU 111 searches user information stored in the storage 114 using the ID acquired in S503 as a search key. As a result of the search, if a user with an identical user ID and an identical password exists, the CPU 111 allows logon. If a user with an identical ID does not exist, or if a user with an identical ID and a different password exists, the CPU 111 does not allow logon. If the CPU 111 allows logon as a result of the collation (S504: Yes), the CPU 111 proceeds to S505. If the CPU 111 does not allow logon (S504: No), the CPU 111 proceeds to S506. In S506, the CPU 111 notifies the user of a failure of the logon and proceeds to S501.

In S505, the CPU 111 acquires user information of the user allowed to log on in S504 and temporarily stores the user information in the RAM 113. The information acquired here is the user ID 301 and the role 304 (user authority information), the e-mail address 303 of the user, and the like. Various types of information acquired at the time of logon are used in the subsequent processes. Then, the logon process is completed.

In the present embodiment, although a case to determine whether to allow logon of a user using user information stored in the storage 114 of the MFP 101 has been described, logon authentication is not limited to such a case. Alternatively, the MFP 101 connects to an external authentication server via the communication unit I/F 123 and uses an authentication result of the external authentication server. In this case, authentication information is transmitted to and received from the external authentication server using a publicly known technology, such as, for example, the Lightweight Directory Access Protocol (LDAP).

Returning to FIG. 4, after the logon process in S402, the CPU 111 performs a display button determination process in S403. The display button determination process is a process to determine a button (an icon) to be displayed on a main screen. The main screen here is a screen on which the user selects a function to use.

Figure 7:
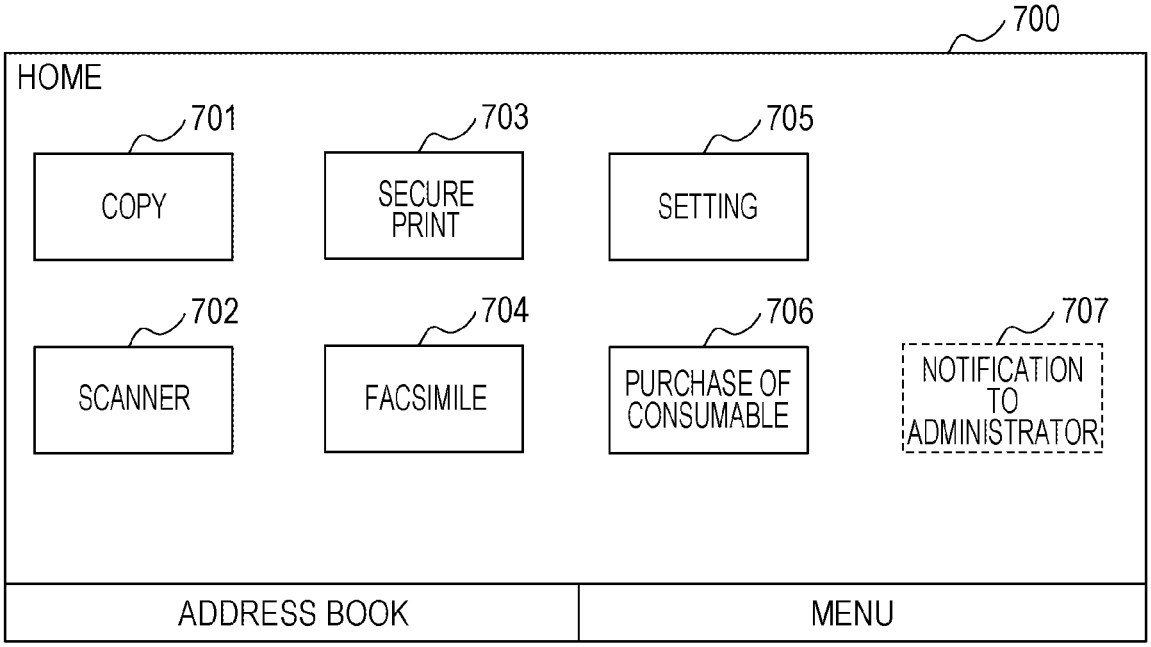
FIG. 7 illustrates an example of a main screen.

FIG. 7 illustrates an example of a main screen. On the main screen 700 illustrated in FIG. 7, a copy button 701, a scanner button 702, a secure print button 703, a fax button 704, a setting button 705, and a consumable purchase button 706 are displayed. When each of the buttons 701 to 704 is selected, an execution screen of a corresponding function is displayed. When the user performs setting of the copy process, the fax transmission process etc. via the execution screen of each function and issues an execution instruction thereof, the MFP 101 performs the copy process and the fax transmission based on the setting. When the setting button 705 is selected, a setting screen on which various types of settings are to be performed will be displayed. When the consumable purchase button 706 is selected, a process related to the purchase of a consumable will be performed.

The consumable purchase button 706 and an administrator notification button 707 are displayed when the remaining amount of the consumable decreases below a threshold, and either of the buttons is selectively displayed. When the administrator notification button 707 is displayed, a notification screen is displayed to the administrator. In the display button determination process, display and non-display of the consumable purchase button 706 and the administrator notification button 707 are determined. The MFP 101 can display the buttons 701 to 706 upon scrolling instead of displaying all the buttons 701 to 706 on a single screen.

Figure 8:
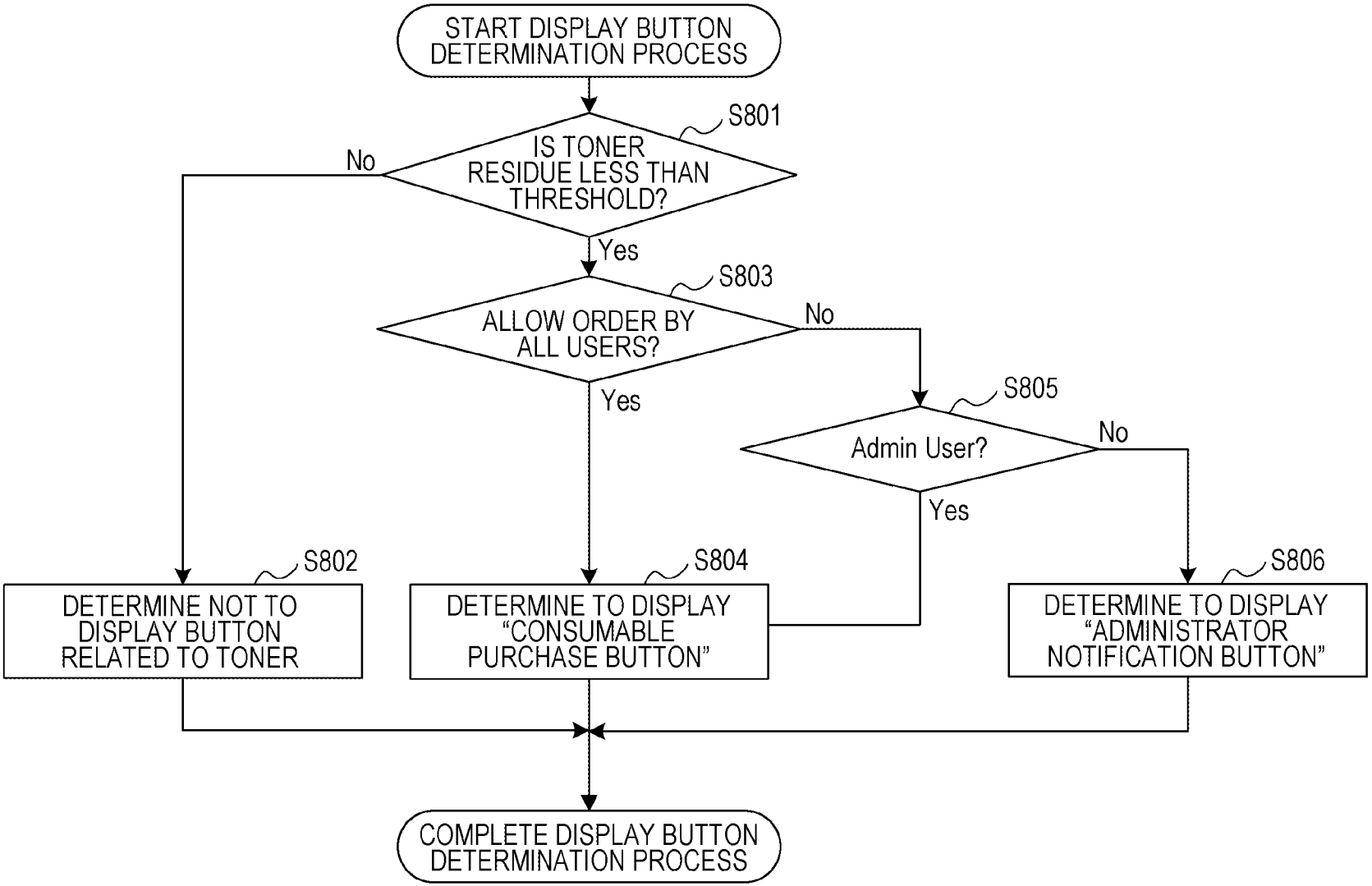
FIG. 8 is a flowchart illustrating a display button determination process.

FIG. 8 is a flowchart illustrating a detailed process of the display button determination process (S403). In S801, the CPU 111 compares a toner remaining amount stored in the RAM 113 with a predetermined threshold. If the toner remaining amount is less than the threshold (S801: Yes), the CPU 111 proceeds to S803. If the toner remaining amount is greater than or equal to the threshold (S801: No), the CPU 111 proceeds to S802. In S802, the CPU 111 determines not to display a button related to toner on the main screen. In the example of FIG. 8, the CPU 111 determines not to display the consumable purchase button 706 or the administrator notification button 707. Then, the display button determination process is completed.

In S803, the CPU 111 reads order information from the storage 114. The order information here is information denoting a user allowed to perform ordering. In the order information, an administrator or all the users are set as the user allowed to perform ordering. The setting of the user allowed to perform ordering can be set or changed by a user operation performed by an administrator, etc. If all users are allowed to perform ordering (S803: Yes), the CPU 111 proceeds to S804. If all users are not allowed to perform ordering (i.e., if ordering is limited to an administrator) (S803: No), the CPU 111 proceeds to S805. In S804, the CPU 111 determines to display the consumable purchase button 706 and not to display the administrator notification button 707. Then, the display button determination process is completed.

In S805, the CPU 111 specifies user authority. If authority is "Administrator" (S805: Yes), the CPU 111 proceeds to S804. If authority is not "Administrator," i.e., if authority is "GeneralUser" (S805: No), the CPU 111 proceeds to S806. In S806, the CPU 111 determines to display the administrator notification button 707 and not to display the consumable purchase button 706. If the user has (has transferred) management authority of the consumable (e.g., the user has "Supplier" authority described above), the process also proceeds to S804. Then, the display button determination process is completed. The display button determination process is an example of the processing for displaying that controls the display of the button.

Returning to FIG. 4, after the process of S403, the CPU 111 proceeds to S404. In S404, the CPU 111 displays the main screen. At this time, display/nondisplay of the consumable purchase button 706 and the administrator notification button 707 are controlled depending on the determination in the process of S403. If the consumable purchase button 706 is selected in S405 (S405: Yes), the CPU 111 proceeds to S406. If the consumable purchase button 706 is not selected (S405: No), the CPU 111 proceeds to S407.

In S406, the CPU 111 controls to display a two-dimensional code for accessing a purchase site of the consumable. The CPU 111 then proceeds to S401. A URL, a store name, etc. of the purchase site can be set and changed on the setting screen depending on the user operation by an administrator, etc.

Figure 9:
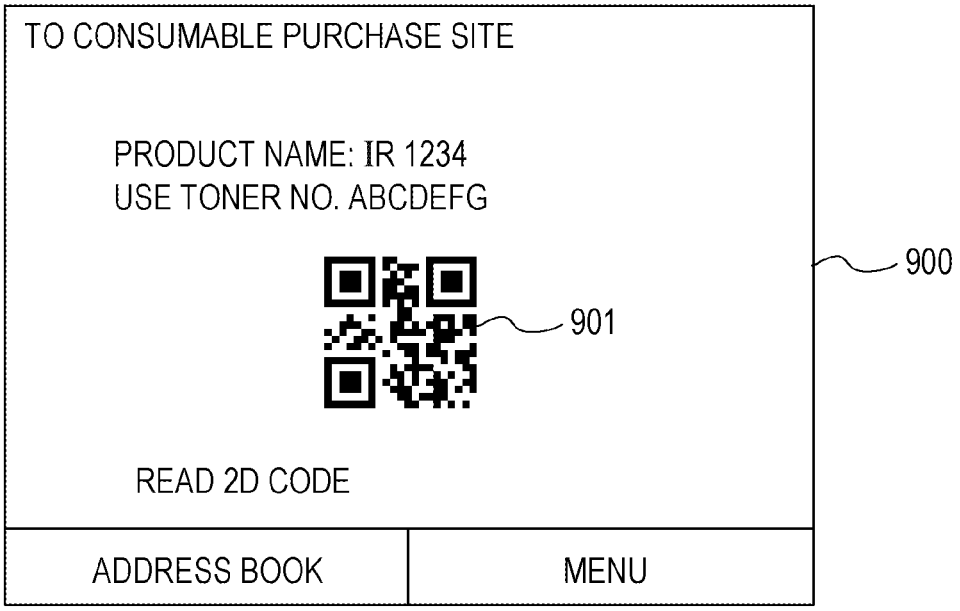
FIG. 9 illustrates an example of a purchase screen.

FIG. 9 illustrates an example of a purchase screen displayed in S406. A two-dimensional code 901 is displayed on the purchase screen 900. The purchase screen 900 here is an example of a display screen on which a purchase site is to be displayed. The two-dimensional code 901 includes a URL for accessing an electronic commerce (EC) site of a vendor of a consumable and other information. The user can easily access a consumable purchase site by reading the two-dimensional code 901 with, for example, a camera of a mobile terminal, and the like.

Figure 10:
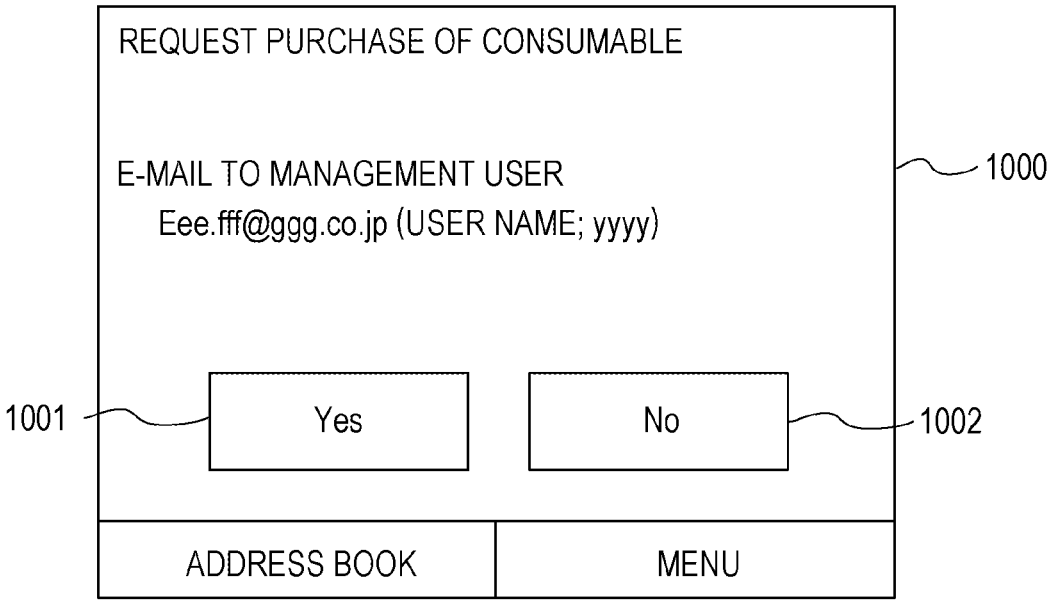
FIG. 10 illustrates an example of a notification screen.

Returning to FIG. 4, if the administrator notification button 707 is selected in S407 (S407: Yes), the CPU 111 proceeds to S408. If the administrator notice button 707 is not selected (S407: No), the CPU 111 proceeds to S410. In S408, the CPU 111 controls to display a notification screen to the administrator. FIG. 10 illustrates an example of a notification screen. An e-mail address of the administrator is displayed on a notification screen 1000, and a "Yes" button 1001 and a "No" button 1002 are displayed with respect to an e-mail notification. If the "Yes" button 1001 is selected by the user, the CPU 111 transmits an e-mail to the administrator to request the purchase of the consumable in S409. The CPU 111 then proceed the process to S401.

Here, the administrator of the notification destination is set in advance based on the user operation by the administrator etc. and is stored in the storage 114. The CPU 111 performs display control in S408 and transmission control of the e-mail in S409 with reference to the administrator information of the notification destination stored in the storage 114. For example, all the users set as the administrators in the user information 300 can be set as the notification destinations, or at least one or a plurality of the users from among the users set as the administrators in the user information 300 can be set as the notification destinations. The administrator of the notification destination can set and change on the setting screen, based on the user operation performed by the administrator, etc. The e-mail address of the administrator can be acquired from the user information 300. The processes in S406 and S409 are examples of the purchase process in which different processes related to the purchase of consumables are performed.

In S410, if the CPU 111 receives an instruction based on selection of a button of a button other than the consumable purchase button 706 and the administrator notice button 707 (S410: Yes), the CPU 111 proceeds to S411. In S411, the CPU 111 executes various functions based on the instruction (e.g., a copy function and a file transmission function). Upon completion of the processing of S411, the CPU 111 then proceeds to S401. If the CPU 111 does not receive an instruction based on selection of a button (S410: No), the CPU 111 proceeds to S412. If an instruction to power off is issued in S412 (S412: Yes), the CPU 111 completes the consumable management process. If an instruction to power off is not issued (S412: No), the CPU 111 returns to the process of S401 and waits for an operation performed by the user.

As described above, in the present embodiment, the MFP 101 displays different buttons corresponding to different processes regarding the purchase of consumables based on user authority. Therefore, the user is not able to perform any actions other than selection of a button corresponding to the process based on the user's authority. Thus, the MFP 101 can perform an appropriate process based on user authority regarding purchase of a consumable. In addition, time and effort of the user can be reduced, and an erroneous order of a consumable can be reduced.

As described above, according to the present disclosure, an appropriate process based on user authority regarding the purchase of a consumable can be performed.

While a case in which the MFP 101 controls a button display on the main screen displayed on the panel 201 of the operation unit 116 has been described as an example in the present embodiment, this example is merely illustrative. The present embodiment is also applicable to a case in which a screen for operating the MFP 101 from a remote place is displayed on a display unit of an information terminal different from the MFP 101, such as a PC 102. In this case, the PC 102 performs the display process and a receiving process of the user operation that are described to be performed by the MFP 101 in the embodiment. In this case, the PC 102 receives information on a function to be displayed on a screen to operate the MFP 101 from a remote place, etc., from the MFP 101. The user can transmit print data to the MFP 101 or can change the setting of the MFP 101 via the screen for operating the MFP 101 from a remote place. The display item regarding the purchase of a consumable is displayed on this screen.

In this case, the MFP 101 changes display items regarding the purchase of the consumable displayed on the display unit of the PC 102 based on authority of the user who is logging on from a remote place (also referred to as remote logon) in order to use the screen for operating the MFP 101 from the remote place. Therefore, the process when the display item regarding the purchase of the consumable displayed on the display unit of the PC 102 is selected can be changed based on the authority of the user who is remotely logging on the MFP 101 from the PC 102.

For example, if the consumable purchase button 706 is selected, the MFP 101 can perform a process to purchase a consumable under user authority (administrator authority), and the specific process therefor is not limited to the above-described embodiment. As another example, if the consumable purchase button 706 is selected, the MFP 101 can automatically access a purchase site and can automatically complete a procedure for the purchase of the consumable (order). Similarly, if an administrator notification button 707 is selected, the MFP 101 can perform a process to request the purchase of a consumable from the administrator, and the specific process therefor is not limited to the above-described embodiment. As yet another example, the MFP 101 can automatically transmit an e-mail to the administrator when the administrator notice button 707 is selected. For example, a purchase request can be transmitted to an equipment management system of an organization, etc. using a REST or other mechanisms.

While embodiments of the present disclosure have been described in detail, the present disclosure is not limited to these specific embodiments. Various modifications and changes can be made without departing from the spirit and scope of the present disclosure.

Other Embodiments

Embodiments can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While exemplary embodiments have been described, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-058586 filed Mar. 24, 2017, which is hereby incorporated by reference herein in its entirety.

What is claimed is:

1. An image forming apparatus that forms an image on a sheet with recording material contained in an attached container comprising:

at least one memory device that stores user identification information in association with one of roles; and at least one processor that executes the instructions, the instructions, when executed, causing the apparatus to perform operations comprising:

receiving a user instruction for setting one or more roles as one or more roles that are allowed to purchase a new container;

specifying a role stored in association with user identification information corresponding to a user logged onto the image forming apparatus; and displaying an object for leading the user logged onto the image forming apparatus to a predetermined web page that enables the user to purchase a new container based on the specified role matching one of the set one or more roles.

2. The image forming apparatus according to claim 1, wherein the one or more roles include an administrator.

3. The apparatus according to claim 1, wherein the first display item is a display item for transmitting an order request for the container external to the apparatus.

4. The image forming apparatus according to claim 1, wherein the object to lead the user to the predetermined web page is a button to display QR code that is generated based on the predetermined web page.

5. The image forming apparatus according to claim 1, wherein the at least one processor causes the image forming apparatus to further perform operations comprising:

displaying another object for requesting an administrator of the image forming apparatus to purchase a new container based on the specified role not matching one of the set one or more roles; and transmitting to an external apparatus, upon selection of said another object, a request to the administrator.

6. The apparatus according to claim 1, wherein the least one processor causes the apparatus to further perform operations comprising:

performing control to, based on determination that a remaining amount of the consumable is greater than or equal to a predetermined threshold, not display the first display item even if the specified authority of the logged in user is present.

7. The image forming apparatus according to claim 1, wherein the at least one processor causes the image forming apparatus to further perform operations comprising:

performing control not to display the object based on the specifying role not matching one of the set one or more roles.

8. The image forming apparatus according to claim 1, wherein one or more roles are set, from a plurality of roles including an administrator and a general user, as one or more roles that are allowed to purchase a new container.

9. The image forming apparatus according to claim 8, the one or more processors further executing instructions which causes the apparatus to perform operations comprising;

in a case where the administrator is set as the one or more roles that are allowed to purchase a new container, display the object to the user who has logged in to the image forming apparatus with user identification information corresponding to the administrator, wherein the object is not displayed to a user who has logged in to the image forming apparatus with user identification information corresponding to the general user.

10. The image forming apparatus according to claim 9, the one or more processors further executing instructions which causes the apparatus to perform operations comprising;

in a case where both the administrator and the general user is set as the one or more roles that are allowed to purchase a new container, display the object to the user who has logged in to the image forming apparatus with user identification information corresponding to either role.

11. A non-transitory computer-readable storage medium storing a program for causing a computer to execute a method for controlling an image forming apparatus that forms an image on a sheet with recording material contained in an attached container, the method comprising:

receiving a user instruction for setting one or more roles as one or more roles that are allowed to purchase a new container;

specifying a role stored in association with user identification information corresponding to a user who is logged onto the image forming apparatus; and displaying an object for leading the user logged onto the image forming apparatus to a predetermined web page that enables the user to purchase a new container based on the specified role matching one of the set one or more roles.

12. An image forming apparatus that forms an image on a sheet with recording material contained in an attached container comprising:

at least one memory device; and at least one processor that executes the instructions, the instructions, when executed, causing the apparatus to perform operations comprising:

receiving a user instruction for setting one or more roles as one or more roles that are allowed to purchase a new container;

specifying a role of a user logged onto the image forming apparatus; and displaying an object for the user whose role matches one of the set one or more roles, wherein based on selection by the user of the object, a web page that enables the user to purchase a new container is displayed.

13. The image forming apparatus according to claim 12, wherein the object is not displayed to a user that has logged in to the image forming apparatus with an authority not matching the set authority.

* * * * *